US006146314A

United States Patent [19]

Lee

[11] Patent Number: 6,146,314

[45] **Date of Patent: *Nov. 14, 2000**

[54] PEDAL-TYPE EXERCISER

[75] Inventor: Sunny Lee, Nan-Tou Hsien, Taiwan

[73] Assignee: Stamina Products, Inc., Springfield, Mo.

[ * ] Notice: This patent is subject to a terminal disclaimer.

[21] Appl. No.: 09/079,153

[22] Filed: May 15, 1998

[51] Int. Cl.[7] ..... A63B 69/16; A63B 22/04

[52] U.S. Cl. ..... 482/57; 482/70; 482/51

[58] Field of Search ..... 482/51–53, 57, 482/70, 79, 80, 58

[56] References Cited

U.S. PATENT DOCUMENTS

| | | | |
|---|---|---|---|
| 140,878 | 7/1873 | Benson . | |
| D. 330,236 | 10/1992 | Jarriel et al. . | |
| D. 398,672 | 9/1998 | Sands et al. . | |
| D. 408,477 | 4/1999 | Arnold et al. . | |
| 2,826,192 | 3/1958 | Mangas . | |
| 2,892,455 | 6/1959 | Hutton . | |
| 3,316,898 | 5/1967 | Brown | 482/51 |
| 3,432,164 | 3/1969 | Deeks . | |
| 3,563,541 | 2/1971 | Sanquist . | |
| 3,713,438 | 1/1973 | Knutsen . | |
| 4,185,622 | 1/1980 | Swenson . | |
| 4,477,072 | 10/1984 | DeCloux . | |
| 4,509,742 | 4/1985 | Cones . | |
| 4,519,603 | 5/1985 | DeCloux . | |
| 4,632,386 | 12/1986 | Beech . | |
| 4,643,419 | 2/1987 | Hyde . | |
| 4,779,863 | 10/1988 | Yang . | |
| 4,786,050 | 11/1988 | Geschwender | 482/57 |
| 4,824,102 | 4/1989 | Lo | 482/59 |
| 5,039,088 | 8/1991 | Shifferaw . | |
| 5,186,697 | 2/1993 | Rennex . | |
| 5,242,343 | 9/1993 | Miller . | |
| 5,279,529 | 1/1994 | Eschenbach . | |
| 5,290,211 | 3/1994 | Steams . | |
| 5,295,928 | 3/1994 | Rennex . | |
| 5,299,993 | 4/1994 | Habing . | |
| 5,352,169 | 10/1994 | Eschenbach . | |
| 5,383,829 | 1/1995 | Miller . | |
| 5,387,167 | 2/1995 | Johnston . | |
| 5,401,226 | 3/1995 | Steams . | |
| 5,403,255 | 4/1995 | Johnston | 482/57 |
| 5,407,409 | 4/1995 | Tang . | |
| 5,423,729 | 6/1995 | Eschenbach . | |

(List continued on next page.)

FOREIGN PATENT DOCUMENTS

| | | |
|---|---|---|
| 815872 | 5/1938 | France . |
| 29 19 494 | 11/1980 | Germany . |
| 206208 | 10/1939 | Sweden . |
| Wo97/49460 | 12/1997 | WIPO . |

*Primary Examiner*—Stephen R. Crow
*Attorney, Agent, or Firm*—Pillsbury Madison & Sutro LLP Intellectual Property Group

[57] ABSTRACT

A pedal-type exerciser includes a first drive assembly having a first horizontal axle mounted rotatably on a rear end portion of a base, first and second drive wheels mounted securely and coaxially on the first horizontal axle, and a pair of first crank arms mounted securely on opposite ends of the first horizontal axle. A second drive assembly has a second horizontal axle mounted rotatably on a front end portion of the base, a third drive wheel mounted securely on the second horizontal axle, a transmission chain trained on the second drive wheel and the third drive wheel, and a pair of second crank arms mounted securely on opposite ends of the second horizontal axle. Each of a pair of elongate pedal members has a front portion with a distal end of a corresponding second crank arm mounted pivotally and slidably therealong, and a rear portion mounted pivotally on a distal end of a corresponding first crank arm. Each of a pair of elongate lever arms has an intermediate portion mounted pivotally on a respective one of opposite sides of an upright prop on the front end portion of the base. Each of a pair of elongate linking rods interconnects pivotally a lower portion of a respective lever arm and the front portion of a respective pedal member.

7 Claims, 6 Drawing Sheets

U.S. PATENT DOCUMENTS 5,496,238 3/1996 Taylor .
5,518,473 5/1996 Miller .
5,527,246 6/1996 Rodgers .
5,529,554 6/1996 Eschenbach .
5,529,555 6/1996 Rodgers, Jr. .
5,540,637 7/1996 Rodgers, Jr. .
5,549,526 8/1996 Rodgers, Jr. .
5,562,574 10/1996 Miller .
5,573,480 11/1996 Rodgers, Jr. .
5,573,481 11/1996 Piercy et al. .
5,577,985 11/1996 Miller .
5,593,372 1/1997 Rodgers, Jr. .
5,595,553 1/1997 Rodgers, Jr. .
5,595,557 1/1997 Lambert, Sr. et al. ..... 482/57
5,630,774 5/1997 Geschwender .
5,637,058 6/1997 Rodgers, Jr. .
5,647,821 7/1997 Johnston ..... 482/57
5,653,662 8/1997 Rodgers, Jr. .
5,685,804 11/1997 Whan-Tong et al. .
5,690,589 11/1997 Rodgers, Jr. .
5,692,994 12/1997 Eschenbach .
5,707,321 1/1998 Maresh .
5,743,834 4/1998 Rodgers, Jr. .
5,746,683 5/1998 Lee .
5,755,642 5/1998 Miller .
5,755,643 5/1998 Sands et al. .
5,759,135 6/1998 Chen .
5,759,136 6/1998 Chen .
5,762,588 6/1998 Chen .
5,766,113 6/1998 Rodgers, Jr. .
5,769,760 6/1998 Lin et al. .
5,772,558 6/1998 Rodgers, Jr. .
5,779,598 7/1998 Lee ..... 482/57
5,779,599 7/1998 Chen .
5,782,722 7/1998 Sands et al. .
5,836,854 11/1998 Kuo .
5,836,855 11/1998 Eschenbach .
5,857,941 1/1999 Maresh et al. .
5,860,895 1/1999 Lee .
5,865,712 2/1999 Chang .
5,882,281 3/1999 Stearns et al. .
5,888,175 3/1999 Chang .
5,888,176 3/1999 Kuo .
5,888,177 3/1999
5,893,820 4/1999 Maresh et al. .
5,895,339 4/1999 Maresh .
5,902,216 5/1999 Lee . ..... Lin .

PEDAL-TYPE EXERCISER

BACKGROUND OF THE INVENTION

1. Field of the Invention

The invention relates to a pedal-type exerciser, more particularly to a pedal-type exerciser which is relatively comfortable to use and which can be operated in a relatively smooth manner.

2. Description of the Related Art

Referring to FIG. 1, a conventional pedal-type exerciser is shown to comprise a base 10 which has a front end portion that is provided with an upright prop 14, and a drive assembly which includes a horizontal axle 100 mounted rotatably on a rear end portion of the base 10, a drive wheel 12 mounted securely and coaxially on the axle 100, and a pair of crank arms 13 mounted securely on opposite ends of the axle 100. A resistance device 11 is mounted on the base 10 and is coupled to the drive wheel 12 for providing resistance to rotation of the axle 100. Each of a pair of elongate lever arms 16 has an intermediate portion mounted pivotally on a respective one of two horizontal pivot shafts 15 that are provided on opposite sides of the upright prop 14. Each of a pair of elongate pedal members 17 has a front portion mounted pivotally on a lower portion of a corresponding one of the lever arms 16, and a rear portion mounted pivotally on a distal end of a corresponding one of the crank arms 13. In use, the user's feet rest on the pedal members 17 while the user's hands grip the upper portions of the lever arms 16. The lever arms 16 are operated to pivot reciprocatingly on the base 10, and the pedal members 17 are alternatingly raised and lowered, thereby resulting in an exercising effect.

The drawbacks of the aforementioned pedal-type exerciser include the following: The pedal members 17 are connected directly to the lever arms 16 at one end, and to the crank arms 13 at the other end. Because the pedal members 17 are relatively short, when the lever arms 16 are pivoted within a relatively large range, a steep height difference will be present between the pedal members 17. Aside from making the pedal-type exerciser uncomfortable to use, injuries can result due to the steep height difference after prolonged use of the exerciser. In addition, the user has to exert a larger amount of force to ensure continued rotation of the drive wheel 12 when the crank arms 13 approach their respective dead zones. The uneven force requirement increases user discomfort and in non-smooth operation of the conventional pedal-type exerciser.

SUMMARY OF THE INVENTION

Therefore, the object of the present invention is to provide a pedal-type exerciser which is relatively comfortable to use and which can be operated in a relatively smooth manner.

Accordingly, the pedal-type exerciser of this invention comprises:

a base having a front end portion provided with an upright prop, and a rear end portion;

a first drive assembly including: a first horizontal axle mounted rotatably on the rear end portion of the base; first and second drive wheels mounted securely and coaxially on the first horizontal axle; and a pair of first crank arms mounted securely on opposite ends of the first horizontal axle;

a second drive assembly including: a second horizontal axle mounted rotatably on the front end portion of the base; a third drive wheel mounted securely on the second horizontal axle; a transmission chain trained on the second drive wheel and the third drive wheel so that rotation of the second drive wheel is transmitted to the third drive wheel; and a pair of second crank arms mounted securely on opposite ends of the second horizontal axle;

a resistance device mounted on the base and coupled to the first drive wheel for providing resistance to rotation of the first horizontal axle;

a pair of elongate pedal members, each of which has a front portion with a distal end of a corresponding one of the second crank arms mounted pivotally and slidably therealong, and a rear portion mounted pivotally on a distal end of a corresponding one of the first crank arms;

a pair of elongate lever arms, each of which has a lower portion, and an intermediate portion mounted pivotally on a respective one of opposite sides of the upright prop; and a pair of elongate linking rods, each of which has an upper end mounted pivotally on the lower portion of a respective one of the lever arms, and a lower end mounted pivotally on the front portion of a respective one of the pedal members.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
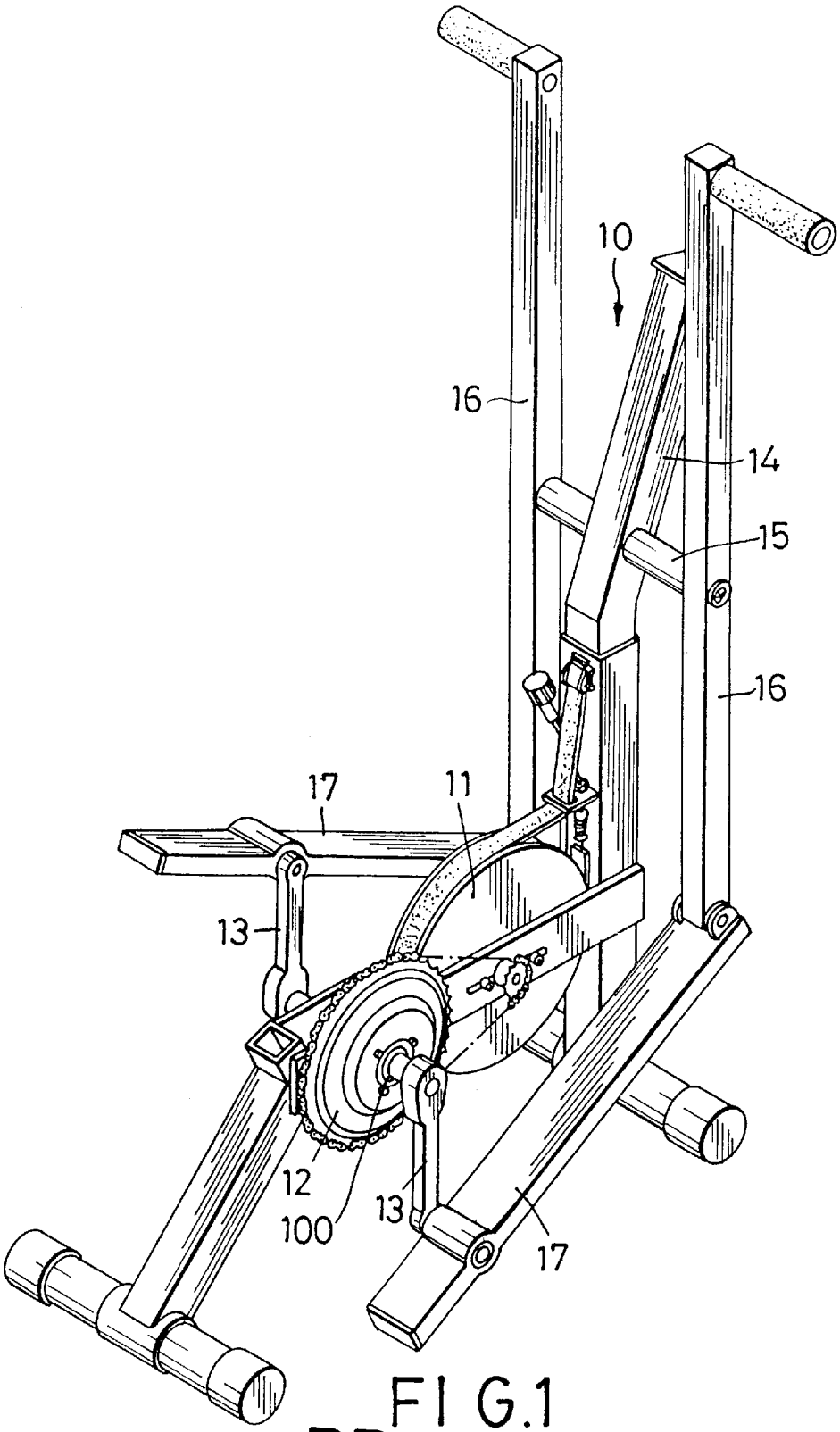
FIG.1 PRIOR ART
FIG. 1 is a perspective view of a conventional pedal-type exerciser.
Figure 2:
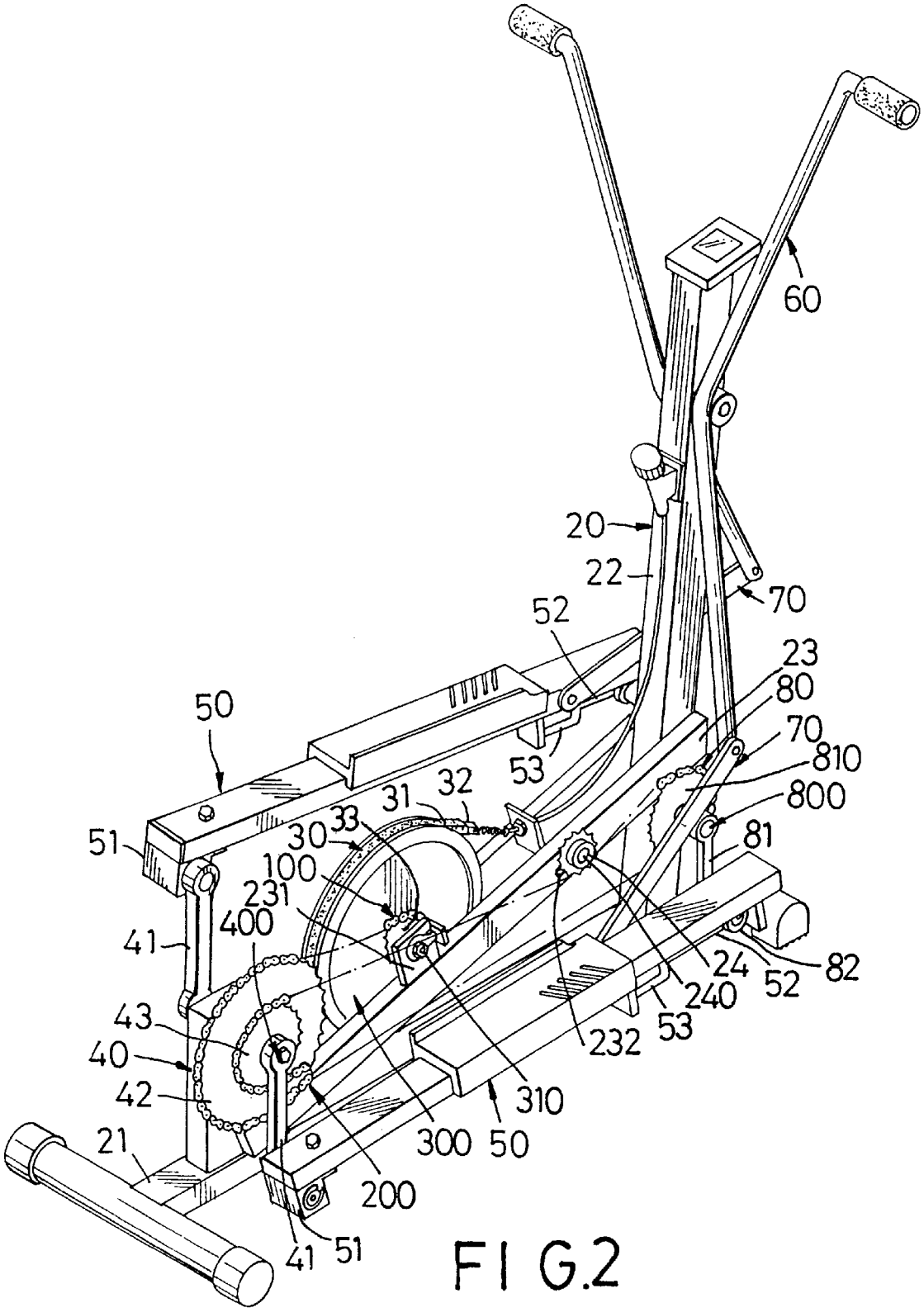
FIG. 2 is a perspective view of the preferred embodiment of a pedal-type exerciser according to the present invention.
Figure 3:
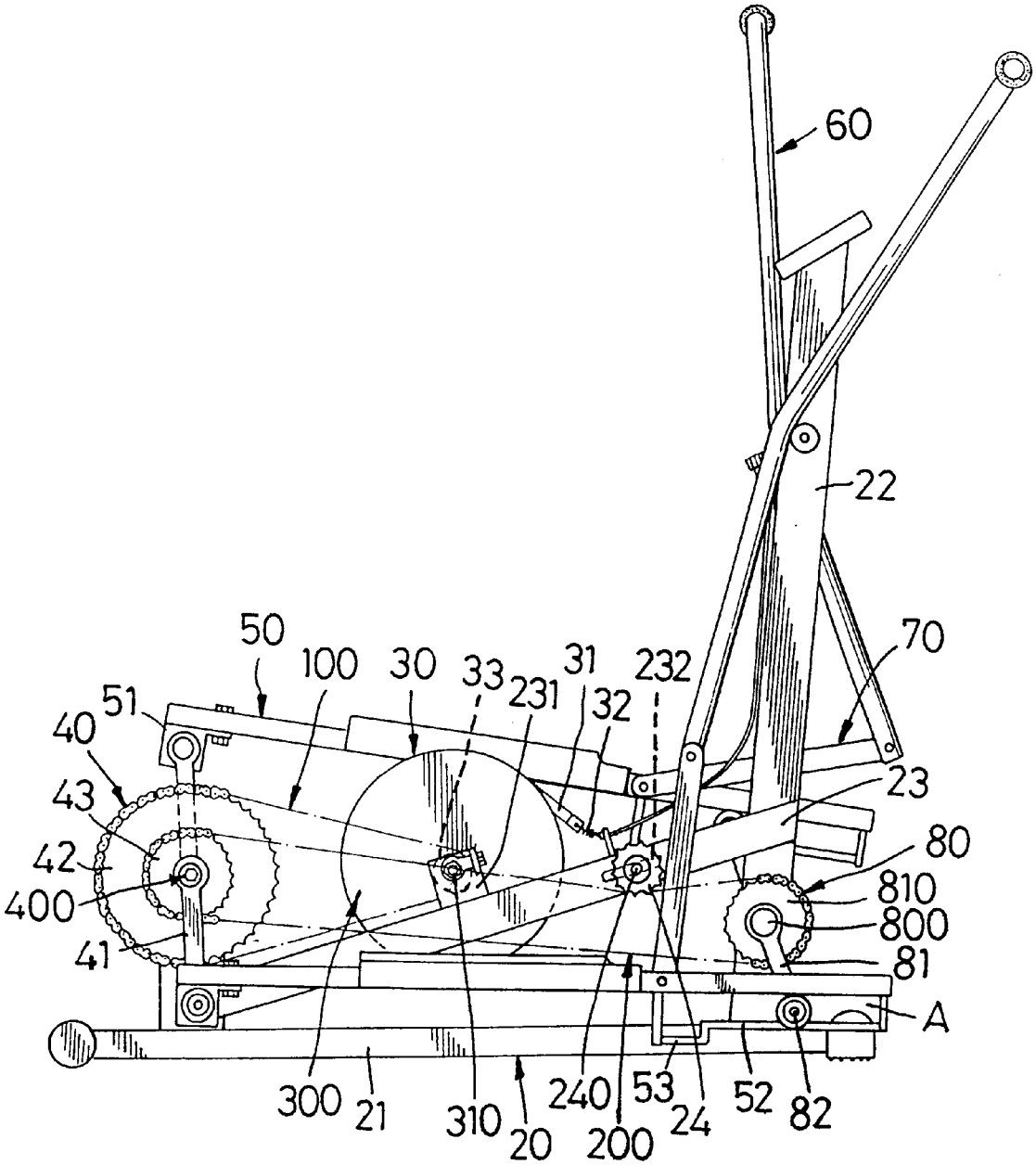
FIG. 3 is a schematic side view of the preferred embodiment.

Referring to FIGS. 2 and 3, the preferred embodiment of a pedal-type exerciser according to the present invention is shown to comprise a base 20, a first drive assembly 40, a second drive assembly 80, a resistance device 30, a pair of elongate pedal members 50, a pair of elongate lever arms 60 and a pair of elongate linking rods 70.

The base 20 includes a generally I-shaped horizontal base member 21 which is adapted to be supported on a ground surface, an upright prop 22 which is provided on a front end portion of the base member 21, and an inclined beam 23 which has opposite ends connected to the base member 21 and the upright prop 22.

The first drive assembly 40 includes a first horizontal axle 400, first and second drive wheels 42, 43, and a pair of first crank arms 41. The first horizontal axle 400 is mounted rotatably on a rear end portion of the base member 21. The first and second drive wheels 42, 43 are mounted securely and coaxially on the first horizontal axle 400. The first drive wheel 42 is larger than the second drive wheel 43. The first crank arms 41 are mounted securely on opposite ends of the first horizontal axle 400.

The second drive assembly 80 includes a second horizontal axle 800, a third drive wheel 810, a first transmission chain 200, and a pair of second crank arms 81. The second horizontal axle 800 is mounted rotatably on the front end portion of the base member 21. In this embodiment, the second horizontal axle 800 is mounted on a lower portion of the upright prop 22. The third drive wheel 810 is mounted securely on the second horizontal axle 800. The first transmission chain 200 is trained on the second drive wheel 43 and the third drive wheel 810 so that rotation of the second drive wheel 43 is transmitted to the third drive wheel 810. The second crank arms 81 are mounted securely on opposite ends of the second horizontal axle 800.

A tensioning roller 24 presses against the first transmission chain 200 and is mounted rotatably and adjustably on the base 20 SO as to adjust the tension of the first transmission chain 200. In this embodiment, the inclined beam 23 is formed with an adjustment slot 232 therealong. A mounting pin 240 is mounted adjustably in the slot 232 and has the tensioning roller 24 mounted rotatably thereon. As such, by adjusting the position of the tensioning roller 24 on the inclined beam 23, the pressure that is applied by the tensioning roller 24 on the first transmission chain 200 can be varied to vary in turn the tension of the chain 200.

The resistance device 30 is mounted on the base 20 and is coupled to the first drive wheel 42 for providing resistance to rotation of the first horizontal axle 400. In this embodiment, the resistance device 30 comprises a friction wheel 300 mounted rotatably on the inclined beam 23, and a friction belt 31 trained along the friction wheel 300 and having opposed ends mounted on the base 20. The friction belt 31 provides resistance to rotation of the friction wheel 300. Preferably, an adjustable pull unit 32 couples one of the ends of the friction belt 31 to the upright prop 22 so as to permit adjustment of the friction force that is present between the friction belt 31 and the friction wheel 300. A chain wheel 33 is mounted coaxially on one side of the friction wheel 300. A second transmission chain 100 is trained on the first drive wheel 42 and the chain wheel 33 so that rotation of the first drive wheel 42 is transmitted to the friction wheel 300.

Preferably, the inclined beam 23 is formed with a mounting seat 231 between the upright prop 22 and the first drive assembly 40. The mounting seat 231 has an adjustment slot which is formed therethrough and which has a mounting shaft 310 mounted adjustably therein. The mounting shaft 310 has the friction wheel 300 mounted rotatably thereon. Thus, the distance between the friction wheel 300 and the first drive wheel 42 can be varied to adjust the tension of the second transmission chain 100.

Each of the elongate pedal members 50 has a front portion with a distal end of a corresponding one of the second crank arms 81 mounted pivotally and slidably therealong, and a rear portion mounted pivotally on a distal end of a corresponding one of the first crank arms 41. In this embodiment, each of the second crank arms 81 has a roller 82 mounted rotatably on the distal end thereof. The front end portion of each of the pedal members 50 has a bottom side with a longitudinal rail member 52 mounted thereto, thereby forming a longitudinal rail groove (A) through opposed side faces of the pedal member 50. The rail groove (A) rollingly receives the roller 82 on the corresponding one of the second crank arms 81. The rail member 52 has a stepped rear portion 53 so that the rail groove (A) in each of the pedal members 50 has a deeper rear section to facilitate installation of the roller 82 on the corresponding one of the second crank arms 81 in the rail groove (A).

Figure 6:
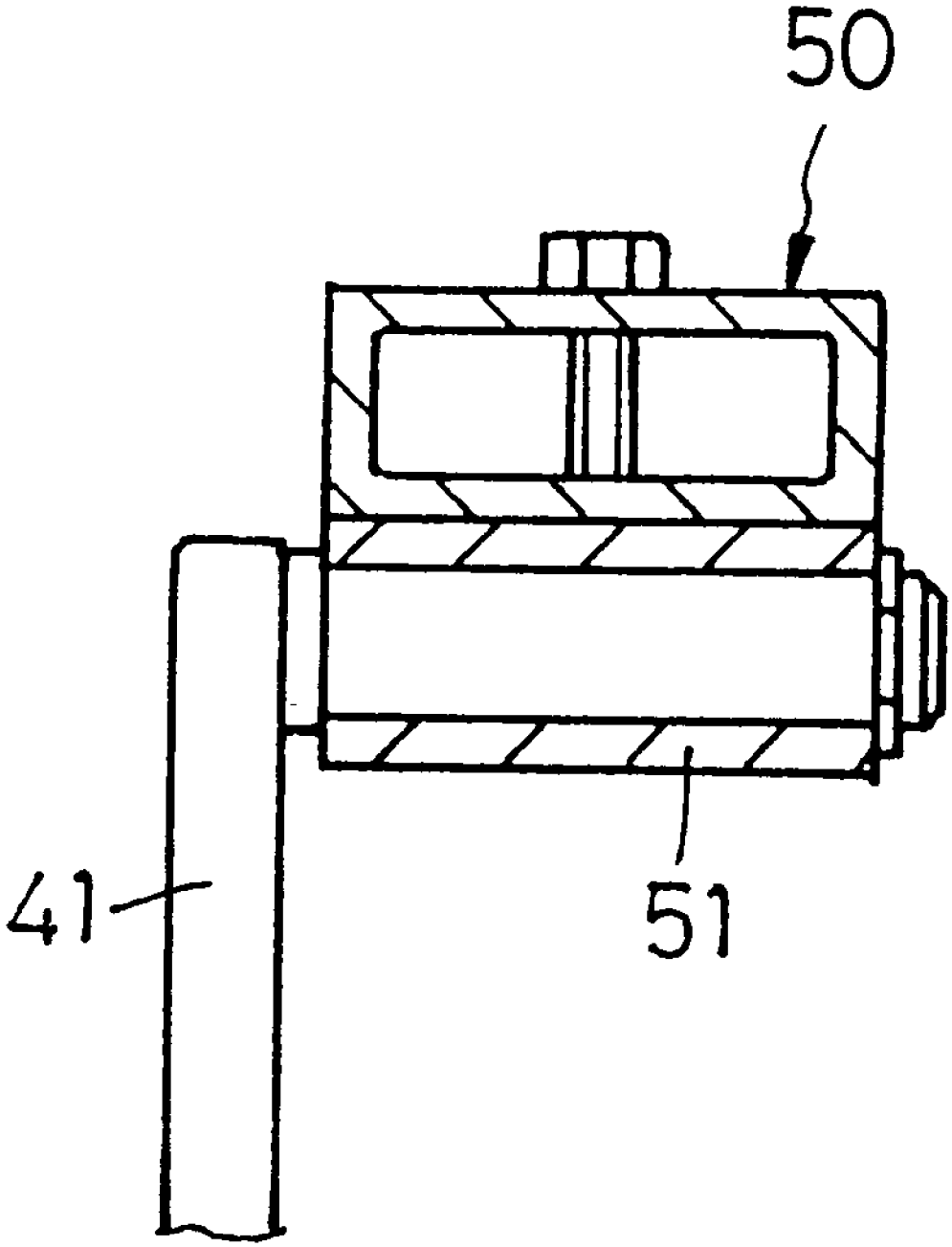
FIG. 6 is a sectional view illustrating the connection between a first crank arm and an elongate pedal member of the preferred embodiment.

As shown in FIG. 6, the rear portion of each of the pedal members 50 has a bottom side provided with a rectangular coupling block 51 for mounting pivotally on the distal end of the corresponding one of the first crank arms 41. As such, movement of the pedal members 50 can result in rotation of the first crank arms 41.

Referring again to FIGS. 2 and 3, each of the lever arms 60 has an intermediate portion mounted pivotally on a respective one of opposite sides of an upper portion of the upright prop 22.

Each of the linking rods 70 has an upper end mounted pivotally on the lower portion of a respective one of the lever arms 60, and a lower end mounted pivotally on the front portion of a respective one of the pedal members 50 adjacent to the rear section of the rail groove (A). Thus, operation of the lever arms 60 can result in movement of the pedal members 50.

Preferably, the first and second crank arms 41, 81 are arranged so that they do not reach their respective dead zones at the same time, as illustrated in FIG. 3. Therefore, when the first crank arms 41 reach their dead zones, the second crank arms 81 have yet to reach their corresponding dead zones. At this time, rotation of the second crank arms 81 is transmitted to the first crank arms 41 via the first transmission chain 200 to help the first crank arms 41 move past the respective dead zones. Accordingly, when the second crank arms 81 reach their dead zones, the first crank arms 41 have yet to reach their corresponding dead zones, and rotation of the first crank arms 41 is transmitted to the second crank arms 81 via the first transmission chain 200 to aid in movement of the second crank arms 81 past the respective dead zones. As such, the need to exert a larger amount of force when the first and second crank arms 41, 81 approach their respective dead zones is obviated. Since the exertion of uneven forces is not required when the exerciser of this invention is in use, user discomfort can be reduced and smooth operation of the exerciser can be ensured.

Figure 4:
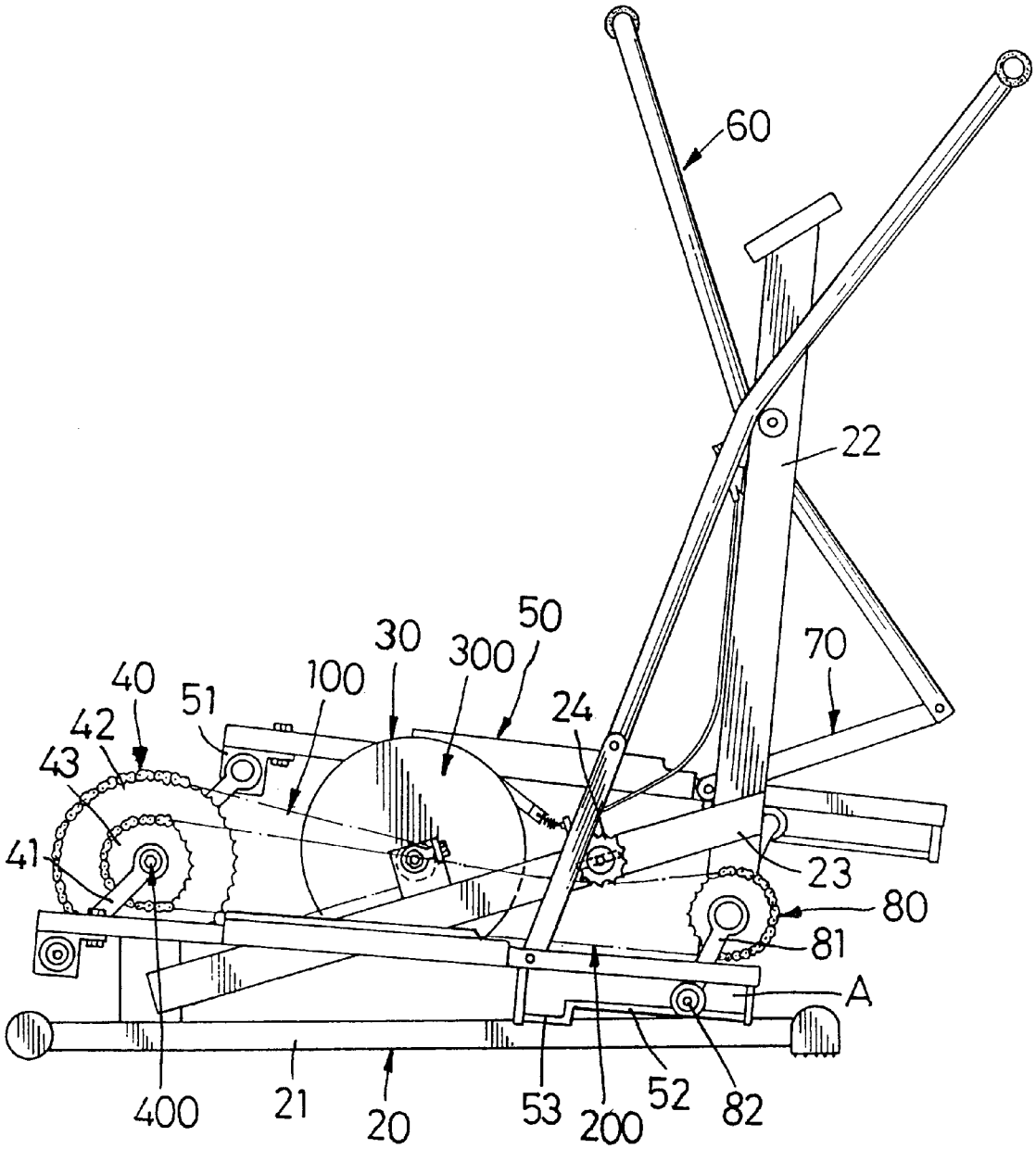
FIGS. 4 and 5 illustrate the operation of the preferred embodiment.
Figure 5:
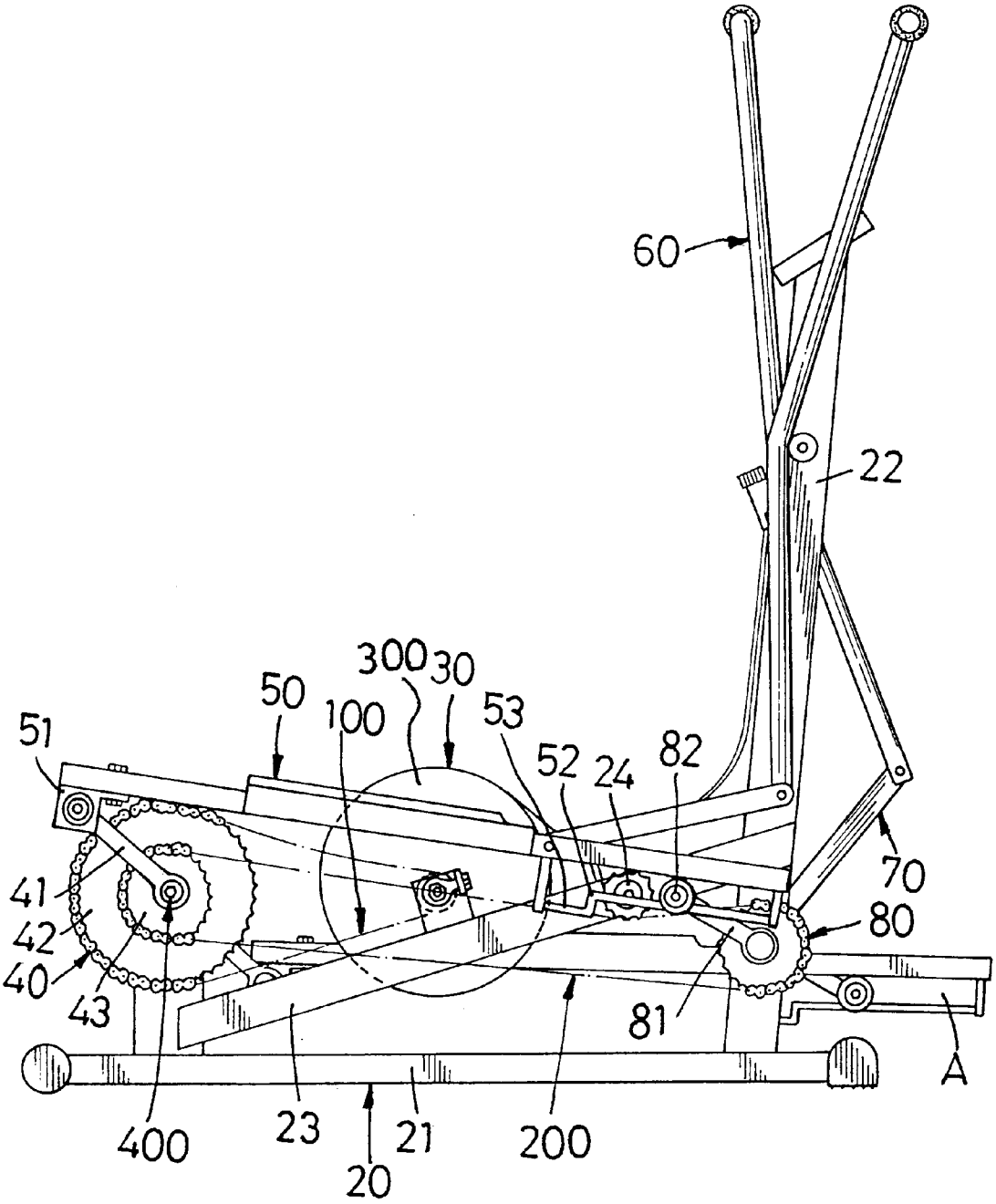

Referring to FIGS. 4 and 5, in use, the user's feet rest on the pedal members 50 while the user's hands grip the upper portions of the lever arms 60. The lever arms 60 are operated to pivot reciprocatingly on the upright prop 22, and the pedal members 50 are alternatingly raised and lowered, thereby driving the first crank arms 41 and the first and second drive wheels 42, 43 to rotate. Since the first drive wheel 42 is coupled to the friction wheel 300 via the second transmission chain 100, the resistance device 30 can provide resistance to rotation of first drive wheel 42 on the first horizontal axle 400, thereby resulting in an exercising effect for the user of the exerciser of this invention.

As mentioned hereinbefore, the second drive wheel 43 is coupled to the third drive wheel 810 via the first transmission chain 200, the second crank arms 81 have distal ends mounted pivotally and slidably along the front portion of the respective pedal member 50, and the front portions of the pedal members 50 are connected to the lever arms 60 via the linking rods 70. Therefore, aside from being rotatable along vertical planes, the pedal members 50 are also movable forwardly and rearwardly relative to the base 20. Hence, the pedal members 50, which move in generally oval paths when the exerciser is in use, do not form steep inclines and further do not form a steep height difference therebetween to make the pedal-type exerciser of the present invention more comfortable to use and to avoid injuries to the user after prolonged use of the exerciser.

It should be noted that the stepped rear portion 53 of the rail member 52 only serves to facilitate installation of the roller 82 in the rail groove (A). In practice, the length of the rail member 52 should be sufficient so as to prevent the roller 82 from reaching the stepped rear portion 53 of the rail member 52 when the exerciser is in use.

Note also that the orientation of the oval paths of the pedal members 50 can be varied by varying the lengths of the first and second crank arms 41, 81. For example, when the lengths of the first and crank arms 41, 81 are the same, the pedal members 50 move along level oval paths. When the first crank arms 41 are shorter than the second crank arms 81, the pedal members 50 move along forwardly and upwardly inclining oval paths. When the first crank arms 41 are longer than the second crank arms 81, the pedal members 50 move along forwardly and downwardly inclining oval paths.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A pedal-type exerciser, comprising:

a base having a front end portion and a rear end portion;

a first drive assembly including: a first axle mounted rotatably on said rear end portion of said base; first and second drive wheels mounted coaxially on said first axle; and a pair of first crank arms mounted securely on opposite ends of said first axle;

a second drive assembly including: a second axle mounted rotatably on said front end portion of said base; a third drive wheel mounted on said second axle; a first transmission chain trained on said second drive wheel and said third drive wheel so that rotation of said second drive wheel is transmitted to said third drive wheel; and a pair of second crank arms mounted securely on opposite ends of said second axle, each of said pair of second crank arms having a length that is different from a length of each of said pair of first crank arms, so that a horizontal extent of movement by distal ends of said first crank arms as said first drive assembly rotates is different from a horizontal extent of movement by distal ends of said second crank arms as said second drive assembly rotates;

a resistance device mounted on said base and coupled to said first drive wheel for providing resistance to rotation of said first axle; and a pair of elongate pedal members, each of which has a front portion and a rear portion, said rear portion of each said pedal member being mounted pivotally on a distal end of a corresponding one of said first crank arms and said front portion of each said pedal member being coupled with a distal end of a corresponding one of said second crank arms so as to permit said distal end of said corresponding second crank arm to pivot and translate with respect to said front portion to accommodate the difference in the horizontal extent of movement between the distal ends of said first and second crank arms.

2. The pedal type-exerciser of claim 1, wherein each of said second crank arms has a roller mounted rotatably on said distal end thereof, said front end portion of each of said pedal members including a longitudinal rail groove for rollingly receiving said roller on the corresponding one of said second crank arms.

3. The pedal-type exerciser of claim 2, wherein said rail groove in each of said pedal members has a deeper rear section to facilitate installation of said roller on the corresponding one of said second crank arms in said rail groove.

4. The pedal-type exerciser of claim 1, wherein said resistance device comprises: a friction wheel mounted rotatably on said base; a friction belt trained along said friction wheel and having opposed ends mounted on said base, said friction belt providing resistance to rotation of said friction wheel; a chain wheel mounted coaxially on one side of said friction wheel; and a second transmission chain trained on said first drive wheel and said chain wheel so that rotation of said first drive wheel is transmitted to said friction wheel.

5. The pedal-type exerciser of claim 4 wherein:

said base includes a mounting seat between said front end portion and said rear end portion, said mounting seat having an adjustment slot which is formed therethrough and which has a mounting shaft mounted adjustably therein, said mounting shaft having said friction wheel mounted rotatably thereon;

whereby, distance between said friction wheel and said first drive wheel is variable to adjust tension of said second transmission chain.

6. The pedal-type exerciser of claim 1, further comprising a tensioning roller which presses against said first transmission chain and which is mounted rotatably and adjustably on said base so as to adjust tension of said first transmission chain.

7. The pedal-type exerciser of claim 1, wherein said rear portion of each of said pedal members has a bottom side provided with a coupling block for mounting pivotally on said distal end of the corresponding one of said first crank arms.

* * * * *